US006300728B1

(12) United States Patent
Blackburn et al.

(10) Patent No.: US 6,300,728 B1
(45) Date of Patent: Oct. 9, 2001

(54) METHOD AND APPARATUS FOR POWERING FLUORESCENT LIGHTING

(75) Inventors: Brian K. Blackburn, Rochester; Joseph F. Mazur, Washington Township Macomb County; Scott B. Gentry, Romeo, all of MI (US)

(73) Assignee: BGM Engineering, Inc., Shelby Township Macomb County, MI (US)

( * ) Notice: Subject to any disclaimer, the term of this patent is extended or adjusted under 35 U.S.C. 154(b) by 0 days.

(21) Appl. No.: 09/596,170

(22) Filed: Jun. 16, 2000

(51) Int. Cl.[7] ..... G05F 1/00

(52) U.S. Cl. ..... 315/307; 315/224; 315/158; 315/159; 250/214 AL; 250/214 C

(58) Field of Search ..... 315/154, 155, 315/158, 159, 224, 291, 307, DIG. 4; 250/214 R, 214 C, 214 D, 214 AL

(56) References Cited

U.S. PATENT DOCUMENTS 5,783,909 * 7/1998 Hochstein ..... 315/159
5,834,908 * 11/1998 Boland et al. ..... 315/307
6,104,134 * 8/2000 Kikuchihara et al. ..... 313/491

OTHER PUBLICATIONS

Description of Conventional Fluorescent Light from Background of Present Application. Dated before Jun. 15, 1999.
Description of Sub–Miniature Fluorescent Light from Background of Present Application. Dated before Jun. 15, 1999.
Practical Electrical Wiring by Richter & Schwan, McGraw–Hill Publishers, NY, NY. pp. 262–267 and 534–537. Dated: 1993.
Product Data Sheets for Sub–Miniature Fluorescent Light Model T4.7SSL (SFL 50) of Stanley Electric Co. Ltd, Tokyo, Japan. Dated: before Jun. 15, 1999.

* cited by examiner

*Primary Examiner*—Haissa Philogene
(74) *Attorney, Agent, or Firm*—Peter D. Keefe

(57) ABSTRACT

The present invention is a power supply for a fluorescent light, particularly a sub-miniature fluorescent light (SFL) which provides compensation for temperature and age effects of the fluorescent light. One or more SFLs are powered by a variable output anode controller and a variable output cathode controller, wherein the illumination output of the SFLs is selectively adjustable based upon the voltage output of one or both of the anode and cathode controllers. In a first example of implementation of the invention, an illumination feedback circuit is provided to the anode/cathode controller, wherein the voltage output is adjusted to compensate for diminished illumination, caused for example by cold operating conditions or age of the sensed SFLs. In a second form of the present invention, a temperature feedback circuit is provided to the anode/cathode controller to provide the aforesaid voltage adjustment to compensate for diminished illumination. In another aspect of the present invention, the SFLs are placed into a ready-state for being presently illuminated based upon sensing of a wake-up signal.

24 Claims, 9 Drawing Sheets

METHOD AND APPARATUS FOR POWERING FLUORESCENT LIGHTING

BACKGROUND OF THE INVENTION

1. Field of the Invention

The present invention relates to fluorescent lighting systems, and more particularly to a fluorescent lighting system adapted for quickly achieving full illumination in cold environments.

2. Description of the Prior Art

In many lighting applications, fluorescent lighting is needed to achieve the proper background illumination. Fluorescent lighting traditionally has provided high illumination at low cost and low power consumption. In contrast with an incandescent light which produces light by heating of a filament, a fluorescent light produces light by exciting atoms of a gas.

An example of a common tube-shaped fluorescent light is depicted at FIG. 1. A fluorescent bulb 10 includes a tubular glass shell 12 which is internally coated with a phosphor 14, such as for example calcium tungstate. Within the glass shell, the air is pumped out and replaced with an inert gas, usually argon. Added to the noble gas is a small amount of mercury. Two mutually spaced apart electrodes 16, 18 are located at either end of the shell. In operation, power is applied to the circuit (120 VAC), and a starter switch 20 is momentarily closed. About a second later, the starter switch opens, whereupon a choke or ballast 22 provides a voltage pulse which causes the gas within the shell to become excited and thereby emit light as electrons strike the gas molecules. The emitted light is mostly in the invisible ultraviolet portion of the spectrum. However, when this emitted light strikes the phosphor 14, the phosphor fluoresces, providing copious amounts of visible light.

A fluorescent light requires a unique power supply that heats the electrode only temporarily to achieve electron excitation of the mercury vapor. The ballast balances the inrush current in combination with a high voltage required for gas excitation. These power supplies require careful attention to design, and add an additional cost above that which would be required to power an incandescent light bulb. In addition, fluorescent lighting is notoriously slow to illuminate at cold temperatures, for example less than about zero degrees C. Still another limitation for the application of fluorescent lighting is the relatively long bulbs that are required. These bulbs have to be packaged with maximum mechanical damping to survive even modest vibrations.

One advance of conventional tube-type fluorescent lighting systems provides quick starting. According to one form of improvement, known as "preheat", the cathode electrodes are preheated when first turned on. When the starter switch opens, the current arcs through the tube, keeping the cathode electrodes hot. According to another form of improvement, known as "instant-start", there is no starter switch and the cathode electrodes are short circuited. A high voltage (for example 500 volts) is applied at the start of the fluorescent light. The high voltage induces illumination, and the ballast returns the voltage to operating levels. According to yet another form of improvement, known as "rapid-start", there is no starter switch, but the cathode electrodes are not short circuited. Special windings in the ballast provide preheat of the cathode windings, and the fluorescent light is started by a high voltage as in the instant-start modality.

A new type of fluorescent lighting system on the market is "sub-miniature fluorescent light" (SFL), an example of which is available from Stanley Electric Co., Ltd. of Tokyo, Japan, and is currently being sold as model T4.7SSL. The Stanley SFL 50, shown at FIGS. 2A and 2B is a low power, low voltage type, having a convexly configured glass shell 52 coated interiorly by a phosphor 56, and filled by an inert gas with a little mercury 54. Electrically, situated within the shell are a cathode 58 having a resistive cathode element 60, an anode 62 spaced from the cathode, and three terminal leads: a ground 64 terminal lead, an anode terminal lead 66, and a cathode terminal lead 68. The Stanley SFL 10 is packaged in a size analogous to small automotive incandescent lights of the type used for automotive interior lights. This small packaging allows for a small bias voltage Va at the anode, typically 24 volts. The cathode element is approximately 26 ohms to the ground terminal lead, requiring a cathode voltage Vc of only 5 volts to provide enough excitation power to warm the ionized gas inside the shell. When the gas warms it is able to conduct anode current to ground through the ionized gas, and light is emitted as electrons strike the mercury atoms. The emitted light is mostly in the invisible ultraviolet UV portion of the spectrum. However, when this emitted light strikes the phosphor 56, the phosphor fluoresces, providing copious amounts of visible light V.

While an SFL is technically improved over conventional fluorescent lights, it still has some drawbacks. For example, if the ambient temperature is cold the cathode warming of the gas is insufficient to conduct the required anode current. This results in a fluorescent light that does not illuminate well at cold temperatures and/or a fluorescent light that takes minutes to warm enough to produce the required illumination. Still another limitation is that the expected life of an SFL is relatively short, for example around 5000 hours. This illumination life is based on an expected decrease of illumination with use, wherein life is considered to have ended when an aged SFL has an illumination output that is one half of that when it was new.

Accordingly, while an SFL overcomes the fluorescent light problems of fragility and power supply complexity, it remains a problem in the art to overcome the disadvantages associated with poor cold starting and short life expectancy.

SUMMARY OF THE INVENTION

The present invention is a power supply for a fluorescent light, particularly a sub-miniature fluorescent light (SFL) which provides compensation for temperature and age effects of the fluorescent light.

One or more SFLs are powered by a variable output anode controller and a variable output cathode controller, wherein the illumination output of the SFLs is selectively adjustable based upon the voltage output of one or both of the anode and cathode controllers.

In a first example of implementation of the invention, an illumination feedback circuit is provided to the anode/cathode controller, wherein the voltage output is adjusted to compensate for diminished illumination, caused for example by cold operating conditions or age of the sensed SFLs. For example, the illumination feedback is provided by a light sensor adjacent one or more of the SFLs which detects the illumination being output by at least one of the SFLs.

In a second form of the present invention, a temperature feedback circuit is provided to the anode/cathode controller to provide the aforesaid voltage adjustment to compensate for diminished illumination. For example, a thermistor adjacent the SFLs provides a temperature signal which is used by a control program to provide adjustment of the anode and/or cathode controller output based upon a predetermined temperature to illumination output relationship.

In another aspect of the present invention, the SFLs are placed into a ready-state for being presently illuminated based upon sensing of a wake-up signal. For example, when a user performs an act, as for example the opening of a car door, a wake-up routine is initiated which adjusts the anode and/or cathode controllers so as to ready the SFLs for illumination in a predetermined present length of time. An example for carrying-out this feature of the invention is to use any of the aforesaid feedback modalities in combination with a predetermined wait-state illumination output from at least one of the SFLs.

Accordingly, it is an object of the present invention to adjust illumination output of fluorescent lighting compensatorily for effects of temperature and age.

It is a further object of the present invention to provide a power supply for a fluorescent lights which includes an illumination feedback circuit which serves as an indicator for power supply output adjustment so that illumination of the fluorescent lights is compensated for any of cold temperature and aging.

It is another object of the present invention to provide a wake-up feature in association with a fluorescent light power supply having illumination compensation capability.

These, and additional objects, advantages, features and benefits of the present invention will become apparent from the following specification.

DETAILED DESCRIPTION OF THE PREFERRED EMBODIMENT

Figure 1:
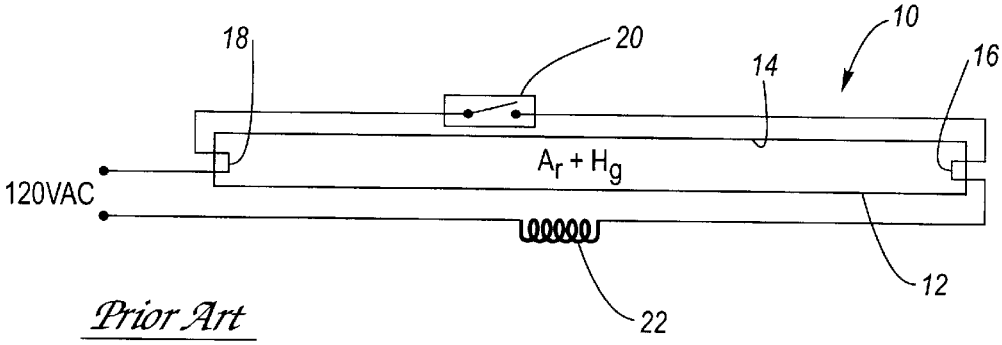
Prior Art Fig. 1
FIG. 1 is a schematic view of a prior art tube-type fluorescent lighting system.
Figure 2A:
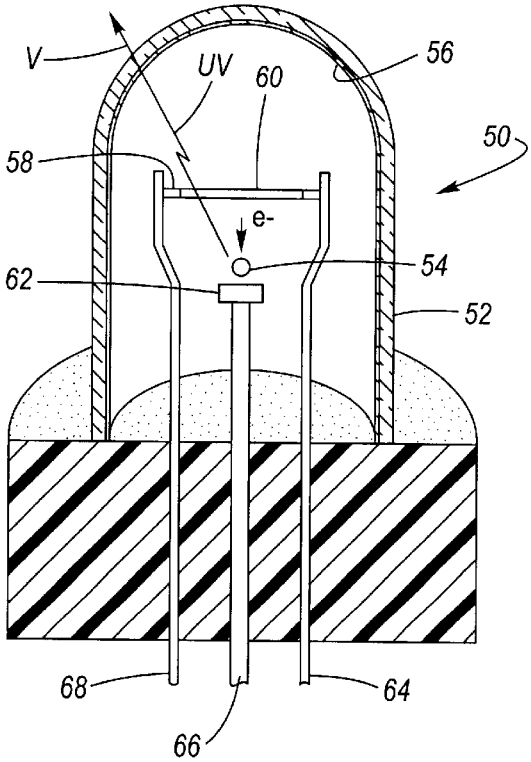
Prior Art Fig. 2A
FIG. 2A is a schematic view of a prior art sub-miniature fluorescent light.
Figure 2B:
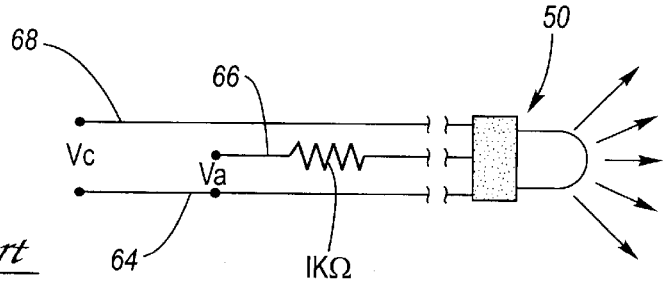
Prior Art Fig. 2B
FIG. 2B is a schematic view of a prior art circuit for a sub-miniature fluorescent light.
Figure 3:
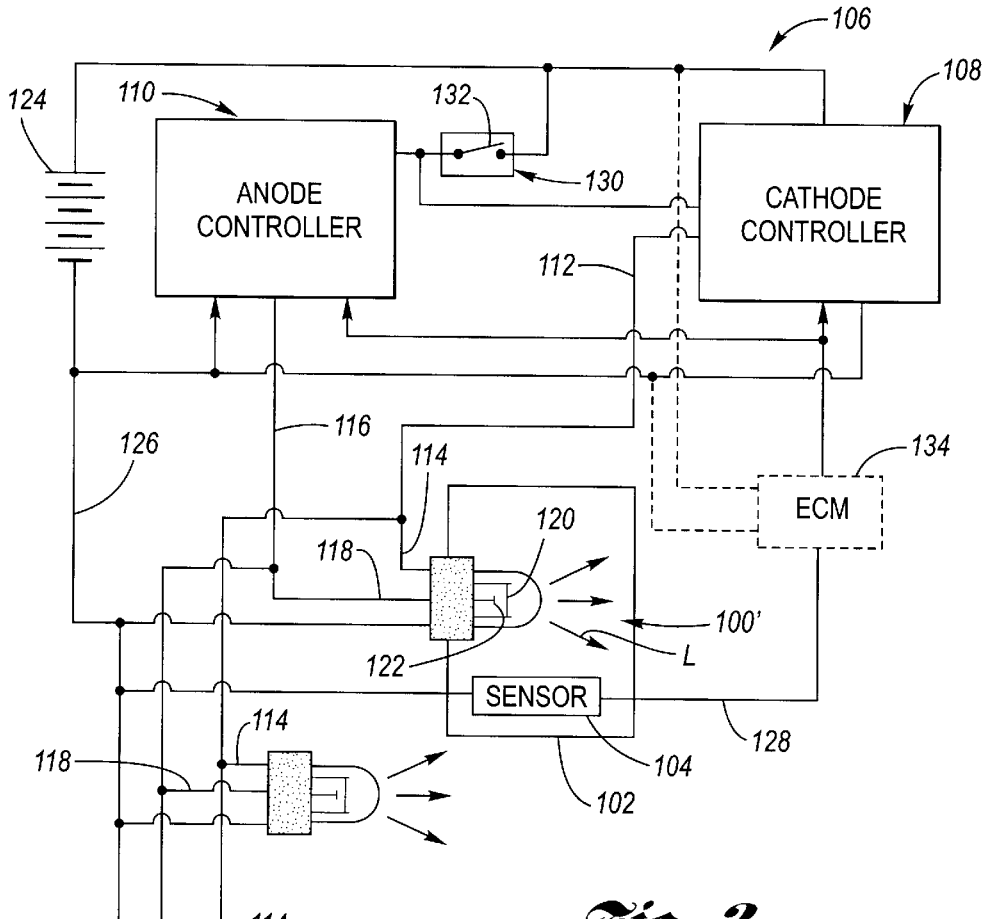
FIG. 3 is a schematic view of a plurality of sub-miniature fluorescent lights, a variable output power supply therefor and a feedback circuit according to the present invention.

Referring now to the Drawing, FIG. 3 depicts a plurality of sub-miniature fluorescent lights (SFLs) 100 connected in parallel, and including an indicator SFL 100'. The indicator SFL is enclosed in a housing 102, which is preferably light-tight. A sensor 104 is located within the housing 102. The sensor 104 senses a predetermined condition of the indicator SFL 100', which condition is a presupposed contemporaneous condition of the other SFLs 100.

The sensor 104, may for example be a light intensity sensor or a temperature sensor. In the case of a light intensity sensor, as for example in the form of a conventional photovoltaic cell, the illumination of the indicator SFL 100' is converted into a sensor signal, the value of which is related to the light intensity L. The sensor signal may be used to sense, for example, a diminished light intensity output of the sensor SFL due to its age or due to a cold operating environment. In the case of a temperature sensor, as for example in the form of a conventional thermocouple or thermistor, the environmental temperature of the indicator SFL 100' is converted into a sensor signal, the value of which is related to the light intensity in that a known relationship exists between the temperature and the light intensity emitted from the SFLs.

Each of the SFLs 100, 100' are powered by a variable power supply 106 including two component controllers: a variable output cathode controller 108 and a variable output anode controller 110. A cathode output lead 112 of the cathode controller 108 is connected to the respective cathode terminal lead 114 of each of the SFLs 100, 100' and an anode output lead 116 from the anode controller 110 is connected to the respective anode terminal lead 118 of each of the SFLs. In this regard, the cathode and anode output leads provide, respectively, the operating voltage for the cathode 120 and anode 122 of each of the SFLs 100, 100'. A power source 124 provides a positive lead 128 to the cathode and anode controllers 108, 110, and a negative lead 126 provides a ground for each of the cathode and anode controllers, the SFLs 100, 100', and the sensor 104.

The sensor signal from the sensor 104 is routed by a sensor feedback lead 128 to each of the cathode and anode controllers 108, 110, although the sensor feedback lead could be connected to just one of the cathode or anode controllers. The voltage level of the sensor signal provides an indicator of operating condition of the SFLs 100, 100', wherein a predetermined adjustment of the voltage at either or both of the cathode output lead 112 and the anode output lead 116 is provided to compensate for the sensed condition, and thereby drive the SFLs such as to provide a desired optimum illumination output.

For example, the illumination output L may be diminished due to either a cold operating temperature of the SFLs or due to age of the SFLs. In any case, the sensor signal voltage will be less than an optimum voltage, due to the diminished light intensity striking the photovoltaic cell. The low sensor voltage is sensed by the circuitry of the cathode and/or anode controllers 108, 110, and a compensatory increase in power voltage at either or both of the cathode and anode output leads 112, 116 is provided which drives the SFLs harder (that is, by increasing release of electrons at the cathode and/or increasing speed of the electrons from the cathode toward the anode), thereby causing an increase in the illumination output. The power voltage may be set to a predetermined value or may be progressively incremented until the sensor signal voltage reaches optimum, or another predetermined value.

For another example, the illumination output L may be diminished due to a cold operating temperature of the SFLs. In any case, the sensor signal voltage will be less than an optimum voltage, due to the low voltage output of the thermistor or thermocouple. The low sensor voltage is sensed by the circuitry of the cathode and/or anode controllers 108, 110, and a compensatory increase in power voltage at either or both of the cathode and anode output leads 112, 116 is provided which drives the SFLs harder, thereby causing an increase in the illumination output, which serves to warm the SFLs. The power voltage may be increased to a predetermined value or may be progressively incremented until the sensor signal voltage reaches optimum, or another predetermined value.

For yet another example, the power supply 106 may provide a wait-state level of illumination output in response to a wake-up signal being received from a wake-up indicator 130, as for example a car door open switch 132 connected to the power source 124. When a voltage appears at a wake-up lead 134, either or both of the cathode and anode controllers provide an appropriate voltage the respective cathode and anode outputs 112, 116 to place the SFLs 100, 100' in condition that enables the SFLs to achieve an operative level of illumination output very rapidly upon the requisite voltage being subsequently applied at the cathode and anode outputs.

Figure 3A:
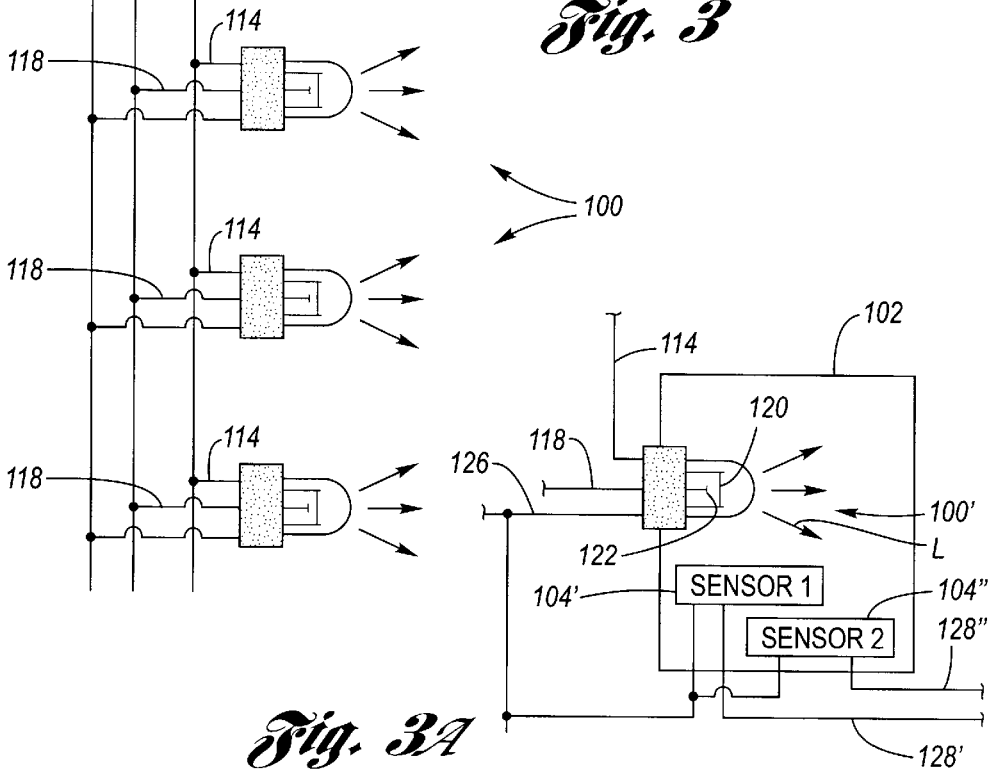
FIG. 3A is a variation of FIG. 3, wherein two sensors are provided in the feedback circuit.

While FIG. 3 depicts an example of the present invention wherein depicted is a plurality of SFLs 100, 100', those having ordinary skill in the relevant art will appreciate that the present invention is readily adaptable to any number of SFLs and any number of sensors, with or without the housing 102. For example, FIG. 3A depicts an indicator SFL 100' and housing 102, wherein SENSOR1 104' is a temperature sensor having a feedback sensor lead 128' to the power supply 106, and SENSOR2 104" is a temperature sensor having a feedback sensor lead 128" to the power supply.

Variations in housing environment, such as for example an opening of a trunk or a change from daylight operation to nighttime operation can be sensed and the power supply may then provide, based upon sensor feedback, cathode and/or anode power voltages which compensate the illumination output of the one or more SFLs to a level appropriate to the sensed condition. Further, it is to be understood that the power voltage compensation performed by the variable power supply 106 may be executed electronically by an appropriately designed electrical circuit or via an appropriately ROM programmed electronic control module (ECM) 134.

Turning attention now to the exemplar examples of FIGS. 4 through 7, a pre-programmed ECM will be assumed, although the indicated steps may be equally well executed electronically by an electrical circuit.

Figure 4:
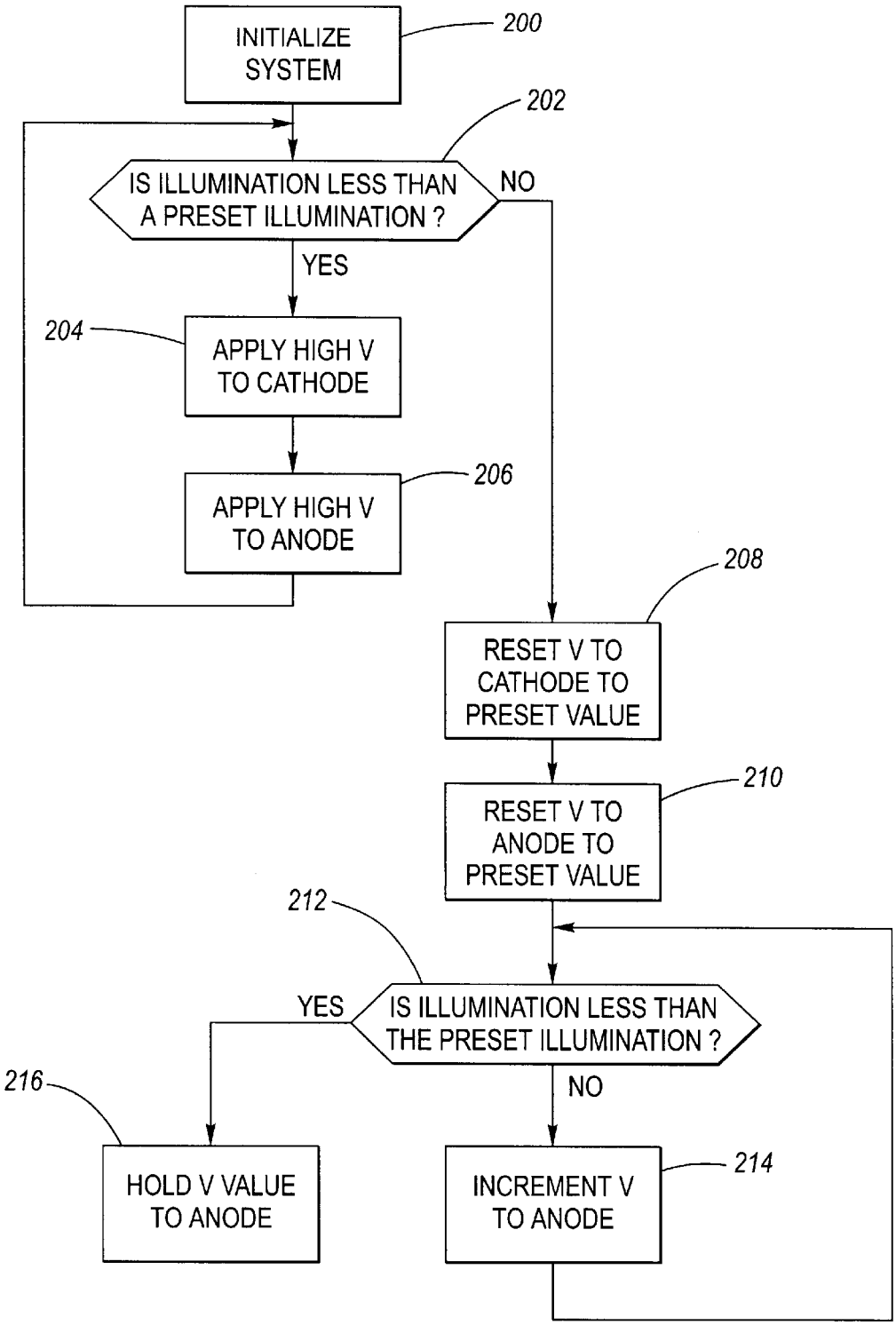
FIG. 4 is a flow chart for compensating sub-miniature fluorescent light illumination, based upon an illumination feedback circuit.

Referring firstly to FIG. 4, depicted is a flow chart of steps performed by the variable power supply 106 to provide a compensated SFL illumination output in response to sensor feedback associated with a light intensity type sensor. The program initializes the power supply at execution block 200 to provide a preset power voltage at the cathode and anode outputs to the one or more SFLs. The program then inquires at decision block 202 whether the illumination output of one or more sensed SFLs is less than a preset illumination. If it is, then at execution blocks 204 and 206, the program applies an incremented power voltage at each of the cathode and anode outputs and then returns to decision block 202. When the illumination output achieves the preset value at decision block 202, the program then resets the power voltage of the cathode and anode outputs to respectively preset values at execution blocks 208 and 210. The program then inquires at decision block 212 whether the illumination output of the one or more sensed SFLs is less than the preset illumination. For example, the illumination could be less than the preset value because of age of the SFLs. If not, the program then increments the power voltage to the anode output at execution block 214 and returns to decision block 212. At decision block 212, when the illumination output is equal to the preset illumination, then at execution block 216 the program holds the last value of power voltage to the anode output.

Figure 5:
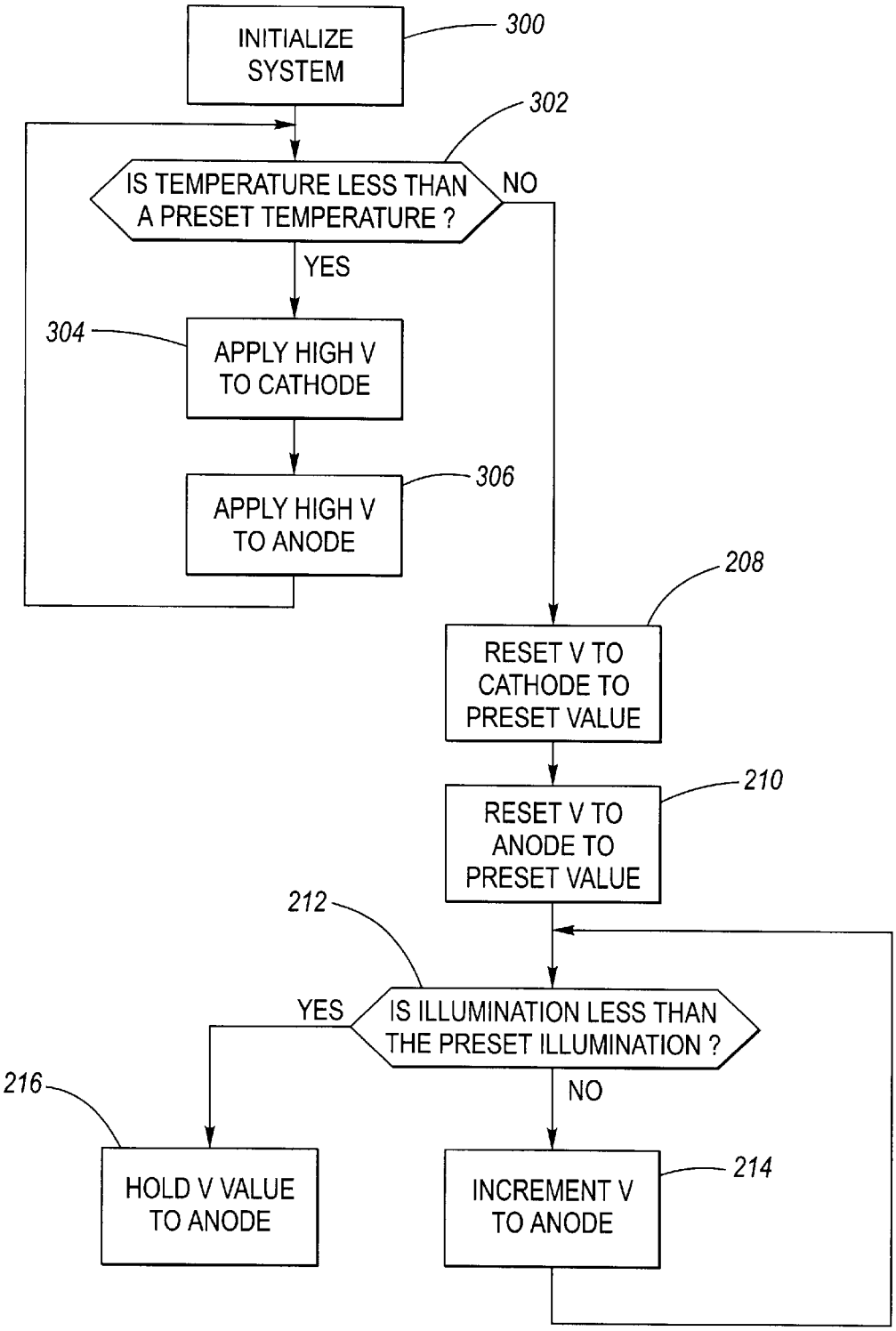
FIG. 5 is a flow chart for compensating sub-miniature fluorescent light illumination, based upon a temperature feedback circuit.

Referring next to FIG. 5 depicted is a flow chart of steps performed by the variable power supply 106 to provide compensated SFL illumination output in response to sensor feedback associated with a light intensity type sensor and a temperature type sensor (see FIG. 3A). The program initializes the power supply at execution block 300 to provide a preset power voltage at the cathode and anode outputs to the one or more SFLs. The program then inquires at decision block 302 whether the temperature adjacent one or more SFL is less than a preset temperature, for example whether the temperature is less than zero degrees centigrade. If it is, then, at execution blocks 304 and 306, the program applies a predetermined higher power voltage at each of the cathode and anode outputs and then returns to decision block 302 and waits. When the temperature achieves the preset value at decision block 302, the program then resets the power voltage of the cathode and anode outputs to respectively preset values at execution blocks 208 and 210, and the program repeats the program steps thereafter depicted at FIG. 4 to provide for age compensation.

Figure 6:
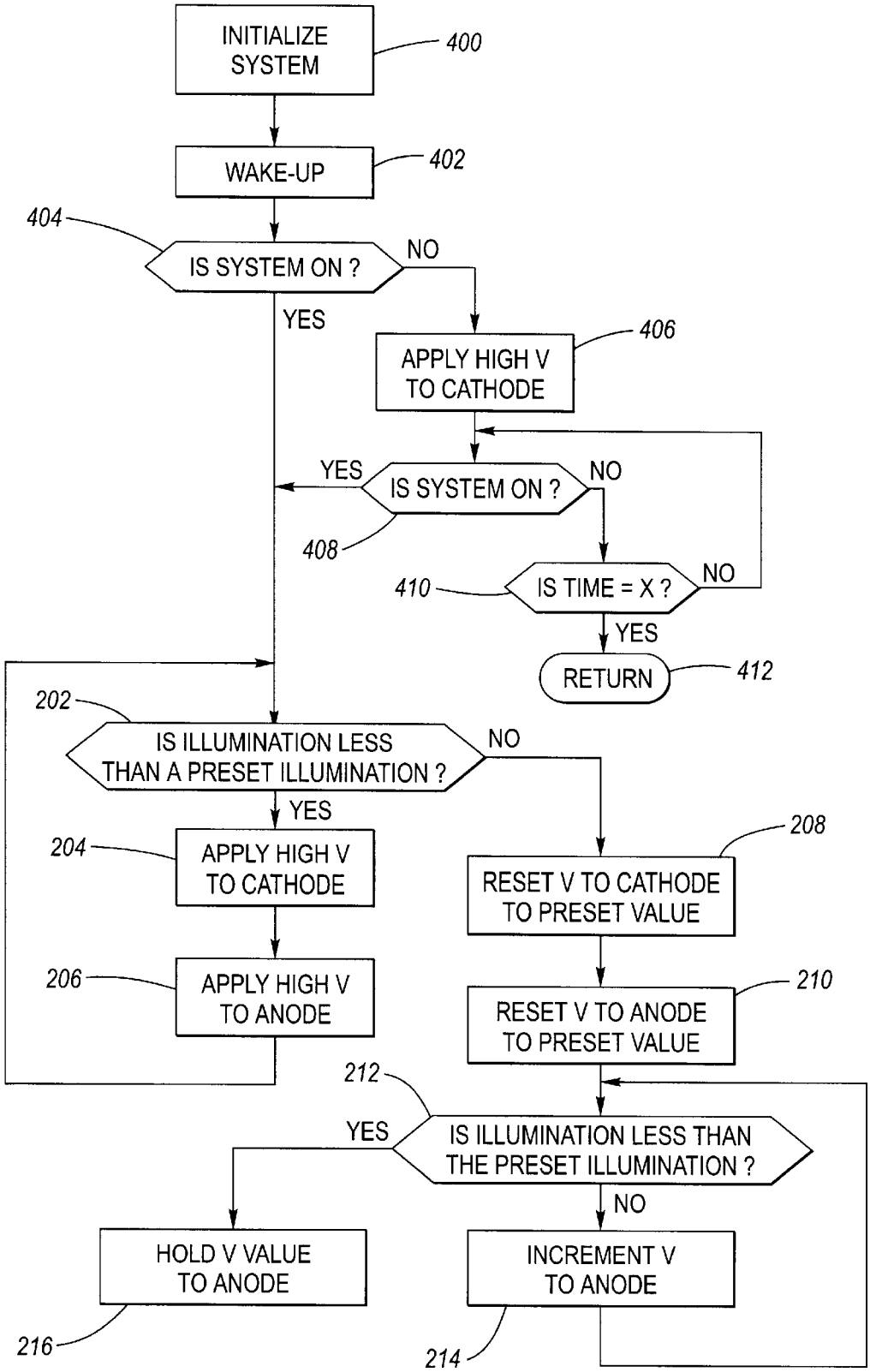
FIG. 6 is a flow chart for providing a wake-up, wait-state illumination for a sub-miniature fluorescent light, based upon an illumination feedback circuit.

Referring next to FIG. 6, depicted is a flow chart of steps performed by the variable power supply 106 to provide a wake-up level of power to the one or more SFLs in conjunction with a feedback circuit associated with a light intensity type sensor. At execution block 400 the system is initialized, wherein the power supply 106 is placed into a wait-for-wake-up-signal mode. At execution block 402 a wake-up signal is provided to the ECM, such as by the wake-up indicator 130. The program then inquires at decision block 404 whether the power supply has been turned on. If not, the program then proceeds to execution block 406 whereat the program applies a predetermined high power voltage to each cathode. At decision block 408 the program inquires whether the system is on. If not, the program waits for a preset amount of time at decision block 410, whereupon if the time has elapsed without the system turning on, then the program returns at execution block 412. If the system turns on during the preset time, then the program advances to decision block 202, and the execution steps indicated thereafter at FIG. 4 are repeated.

Figure 7:
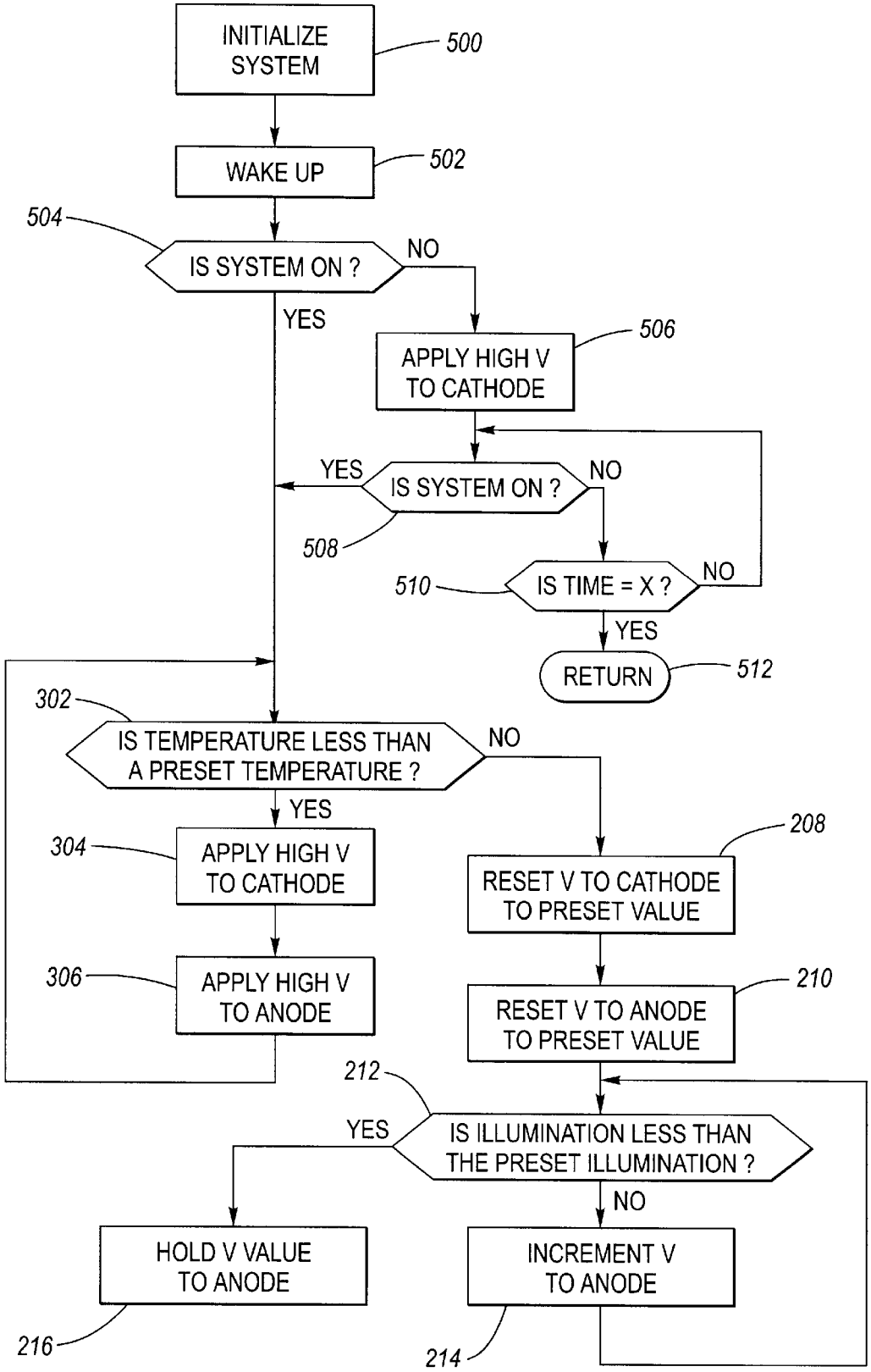
FIG. 7 is a flow chart for providing a wake-up, wait-state illumination for a sub-miniature fluorescent light, based upon a temperature feedback circuit.
Figure 8:
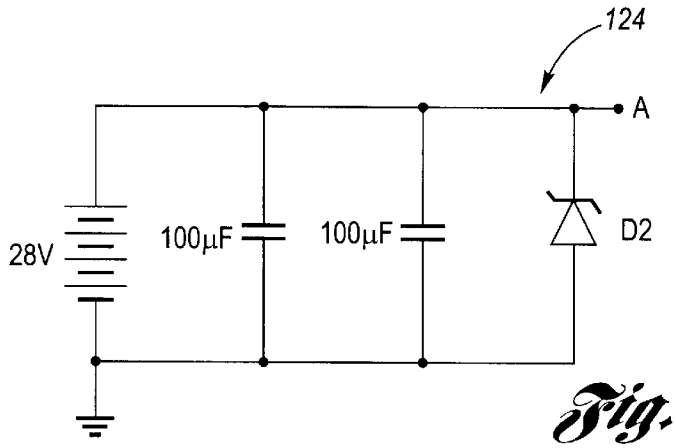
FIG. 8 is a schematic diagram of a power source circuit for a variable output fluorescent light power supply according to the present invention.

Referring next to FIG. 7, depicted is a flow chart of steps performed by the variable power supply 106 to provide a wake-up level of power to the one or more SFLs in conjunction with a feedback circuit associated with a light intensity type sensor and a temperature sensor. At execution block 500 the system is initialized, wherein the power supply 106 is placed into a wait-for-wake-up-signal mode. At execution block 502 a wake-up signal is provided to the ECM, such as by the wake-up indicator 130. The program then inquires at decision block 504 whether the power supply has been turned on. If not, the program then proceeds to execution block 506 whereat the program applies a predetermined high power voltage to each cathode. At decision block 508 the program inquires whether the system is on. If not, the program waits for a preset amount of time at decision block 510, whereupon if the time has elapsed without the system turning on, then the program returns at execution block 512. If the system turns on during the preset time, then the program advances to decision block 302 and the execution steps indicated thereafter at FIG. 5 are repeated. It is to be understood that steps 400 through 410 of FIG. 6 may be substituted for steps 500 through 510 of FIG. 7.

Figure 10:
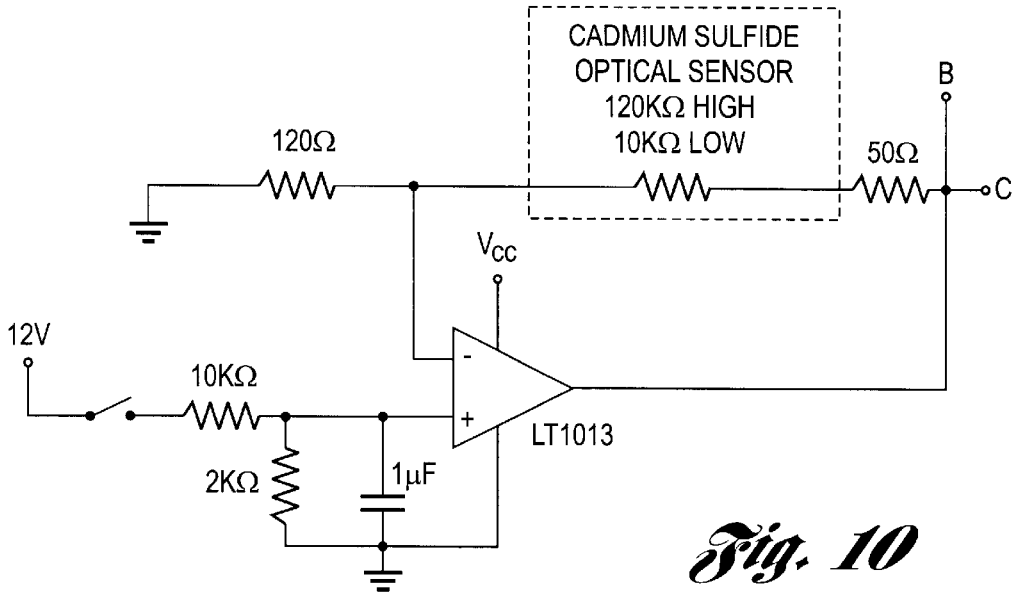
FIG. 10 is a schematic diagram of a feedback control and gain circuit for the cathode controller circuit of FIG. 9.
Figure 12:
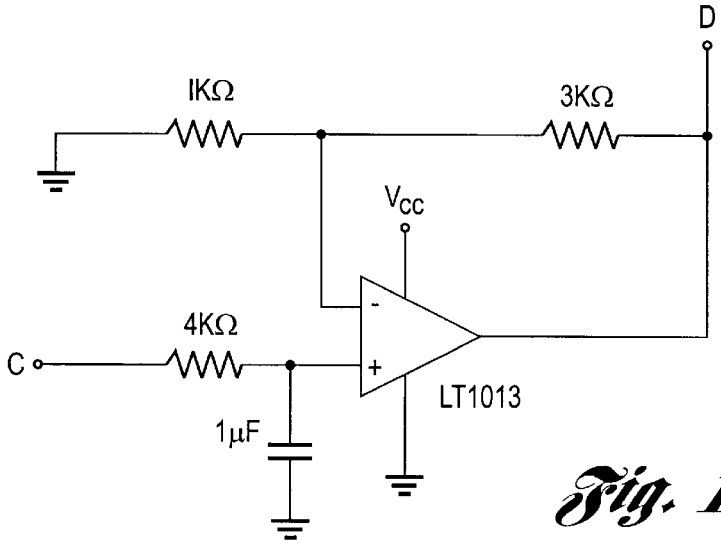
FIG. 12 is a schematic diagram of a gain and filtering circuit for the anode controller circuit of FIG. 11.
Figure 9:
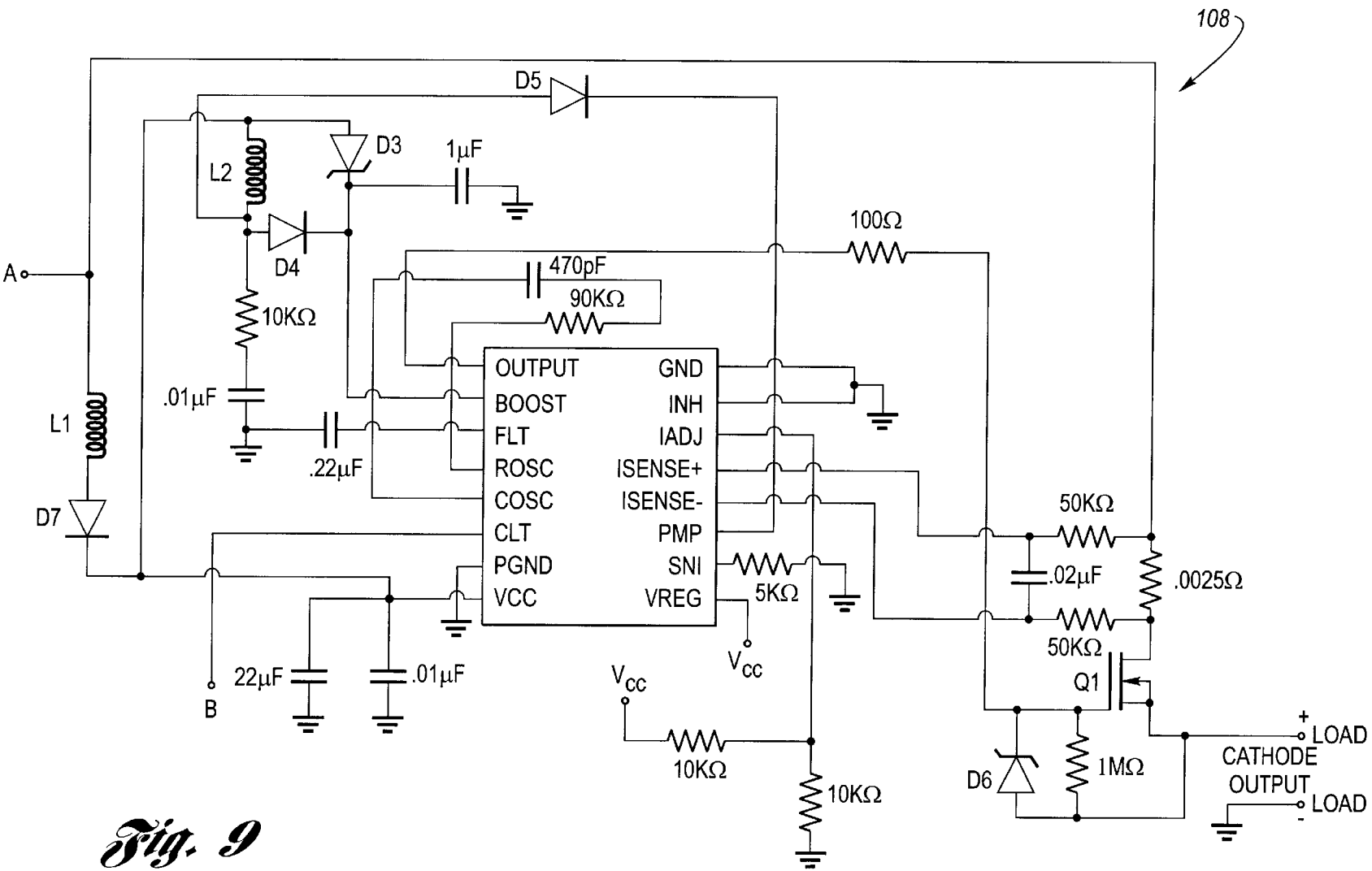
FIG. 9 is a schematic diagram of a cathode controller circuit for the variable output fluorescent light power supply according to the present invention.
Figure 11:
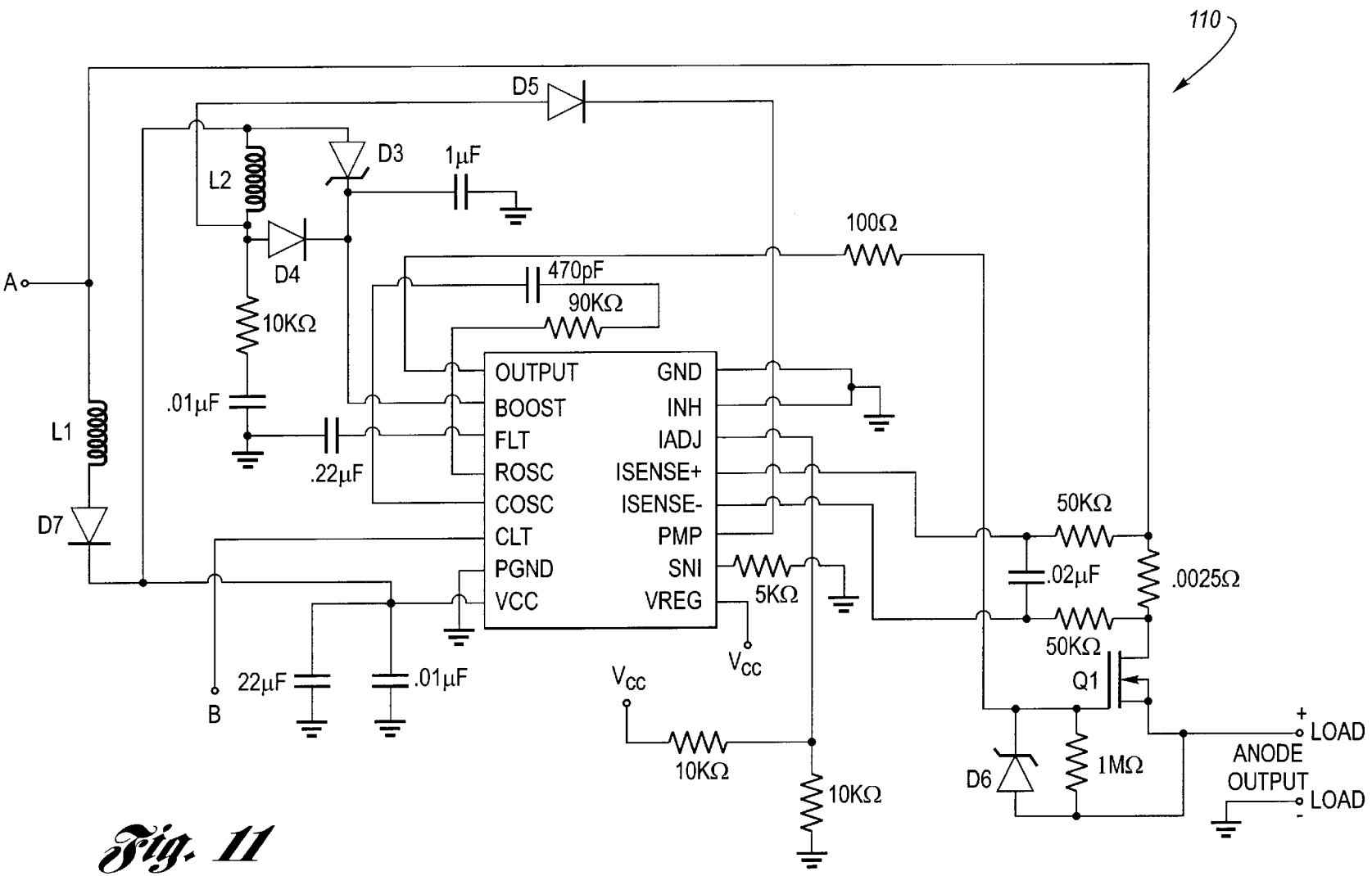
FIG. 11 is a schematic diagram of an anode controller circuit for the variable output fluorescent light power supply according to the present invention.

Turning attention now to FIGS. 8 through 11, FIG. 8 depicts a diagram of a preferred example of a power source circuit 124; FIGS. 9 and 10 depict a preferred example of a cathode controller 108, including a feedback control and gain therefor, as well as a sensor 104; and FIGS. 10 and 11 depict a preferred example of an anode controller 110, including a gain and filtering therefor. A component listing for FIGS. 8 through 11 is as follows: $V_{cc}$ is a positive 5 volts; diode D2 is a SM8A27; diodes D3 and D6 are a MA3091CT; diodes D4, D5 and D7 are a MA152ACT; chokes L1 and L2 are a PM153-471k; N channel MOSFET Q1 is a IRFZ044; and the electronic controller chip of FIGS. 9 and 11 is a PWM controller CS 4124.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A variable power supply for sub-miniature fluorescent lights, comprising:

a power supply comprising an anode controller for providing an anode power output to power an anode of respectively each of one or more sub-miniature flourescent lights and a cathode controller for providing a cathode power output to power a cathode of respectively each of the one or more sub-miniature fluorescent lights;

at least one sensor for sensing at least one condition of at least one of the sub-miniature fluorescent lights; and a feedback circuit connected to the at least one sensor and the power supply for providing an adjustment of at least one of the cathode power output and the anode power output responsive to the sensed at least one condition.

2. The variable power supply of claim 1, wherein said at least one sensor comprises a light sensor and said at least one sensed condition comprises illumination output.

3. The variable power supply of claim 1, wherein said at least one sensor comprises a temperature sensor and said at least one sensed condition comprises temperature.

4. A fluorescent lighting system, comprising:

at least one sub-miniature fluorescent light, each comprising a shell, a cathode within said shell and an anode within said shell;

a power supply comprising an anode controller for providing an a node power output to power the anode of respectively each of the at least one sub-miniature flourescent lights and a cathode controller for providing a cathode power output to power the cathode of respectively each of the at least one sub-miniature fluorescent lights;

at least one sensor for sensing at least one condition of at least one sub-miniature fluorescent light; and a feedback circuit connected to the at least one sensor and the power supply for providing an adjustment of at least one of the cathode power output and the anode power output responsive to the sensed at least one condition.

5. The fluorescent lighting system of claim 4, wherein said at least one sensor comprises a light sensor and said at least one sensed condition comprises illumination output.

6. The fluorescent lighting system of claim 4, wherein said at least one sensor comprises a temperature sensor and said at least one sensed condition comprises temperature.

7. The fluorescent lighting system of claim 4, wherein said at least one sensor comprises:

a light sensor and said at least one sensed condition comprises illumination output; and a temperature sensor and said at least one sensed condition comprises temperature.

8. The fluorescent lighting system of claim 4, further comprising a wake-up circuit responsive to a predetermined signal, wherein at least one of said cathode power output and said anode power output is set to a predetermined low power level responsive to said signal.

9. The fluorescent lighting system of claim 4, wherein said at least one sub-miniature fluorescent light comprises a plurality of sub-miniature fluorescent lights; and wherein said fluorescent lighting system further comprises:

a generally light-tight housing; and a sub-miniature fluorescent light of said plurality of sub-miniature fluorescent lights being located within said housing;

wherein said at least one sensor is located within said housing.

10. The fluorescent lighting system of claim 9, wherein said at least one sensor comprises a light sensor and said at least one sensed condition comprises illumination output.

11. The fluorescent lighting system of claim 9, wherein said at least one sensor comprises a temperature sensor and said at least one sensed condition comprises temperature.

12. The fluorescent lighting system of claim 9, wherein said at least one sensor comprises:

a light sensor and said at least one sensed condition comprises illumination output; and a temperature sensor and said at least one sensed condition comprises temperature.

13. A method for controlling a fluorescent lighting system, comprising the steps of:

applying a predetermined level of power voltage to a cathode and an anode of at least one sub-miniature fluorescent light;

measuring at least one condition of at least one sub-miniature fluorescent light;

comparing the at least one measured condition to a predetermined condition;

adjusting the power voltage to at least one of the cathode and anode of each sub-miniature fluorescent light of the at least one sub-miniature fluorescent light responsive to the comparison.

14. The method of claim 13, further comprising, before said step of applying, the steps of:

receiving a wake-up signal;

applying a second predetermined level of power voltage which is less than said predetermined level of power voltage to at least one of the cathode and the anode of each sub-miniature fluorescent light of the at least one sub-miniature fluorescent light for not more than a predetermined time.

15. The method of claim 13, further comprising the steps of:

reapplying the predetermined level of power voltage to the cathode and anode of each sub-miniature fluorescent light of the at least one sub-miniature fluorescent light;

secondly measuring illumination output of at least one sub-miniature fluorescent light;

secondly comparing the secondly measured illumination output to a second predetermined illumination output value;

secondly adjusting the level of power voltage to at least one of the cathode and anode of each sub-miniature fluorescent light of the at least one sub-miniature fluorescent light responsive to the second comparison to thereby cause the measured illumination output to substantially equal the second predetermined illumination output value.

16. The method of claim 15, further comprising, before said step of applying, the steps of:

receiving a wake-up signal;

applying a third predetermined level of power voltage which is less than said predetermined level of power voltage to at least one of the cathode and the anode of each sub-miniature fluorescent light of the at least one sub-miniature fluorescent light for not more than a predetermined time.

17. The method of claim 13, wherein said steps of measuring, comparing and adjusting comprise:

measuring illumination output of at least one sub-miniature fluorescent light;

comparing the measured illumination output to a predetermined illumination output value;

adjusting the level of power voltage to at least one of the cathode and anode of each sub-miniature fluorescent light of the at least one sub-miniature fluorescent light responsive to the comparison to thereby cause the measured illumination output to substantially equal the predetermined illumination output value.

18. The method of claim 17, further comprising, before said step of applying, the steps of:

receiving a wake-up signal;

applying a second predetermined level of power voltage to at least one of the cathode and the anode of each sub-miniature fluorescent light of the at least one sub-miniature fluorescent light for not more than a predetermined time.

19. The method of claim 17, further comprising the steps of:

reapplying said predetermined level of power voltage to the cathode and anode of each sub-miniature fluorescent light of the at least one sub-miniature fluorescent light;

secondly measuring illumination output of at least one sub-miniature fluorescent light;

secondly comparing the secondly measured illumination output to a second predetermined illumination output value;

secondly adjusting the level of power voltage to at least one of the cathode and anode of each sub-miniature fluorescent light of the at least one sub-miniature fluorescent light responsive to the second comparison to thereby cause the measured illumination output to substantially equal the second predetermined illumination output value.

20. The method of claim 19, further comprising, before said step of applying, the steps of:

receiving a wake-up signal;

applying a third predetermined level of power voltage which is less than said predetermined level of power voltage to at least one of the cathode and the anode of each sub-miniature fluorescent light of the at least one sub-miniature fluorescent light for not more than a predetermined time.

21. The method of claim 13, wherein said steps of measuring, comparing and adjusting comprise:

measuring temperature adjacent at least one sub-miniature fluorescent light;

comparing the measured temperature a predetermined temperature value;

adjusting the level of power voltage to at least one of the cathode and anode of each sub-miniature fluorescent light of the at least one sub-miniature fluorescent light responsive to the comparison to thereby cause the measured temperature to at least equal the predetermined temperature value.

22. The method of claim 21, further comprising, before said step of applying, the steps of:

receiving a wake-up signal;

applying a second predetermined level of power voltage to at least one of the cathode and the anode of each sub-miniature fluorescent light of the at least one sub-miniature fluorescent light for not more than a predetermined time.

23. The method of claim 21, further comprising the steps of:

reapplying said predetermined level of power voltage to the cathode and anode of each sub-miniature fluorescent light of the at least one sub-miniature fluorescent light;

measuring illumination output of at least one sub-miniature fluorescent light;

secondly comparing the measured illumination output to a second predetermined illumination output value;

secondly adjusting the level of power voltage to at least one of the cathode and anode of each sub-miniature fluorescent light of the at least one sub-miniature fluorescent light responsive to the second comparison to thereby cause the measured illumination output to substantially equal the predetermined illumination output value.

24. The method of claim 23, further comprising, before said step of applying, the steps of:

receiving a wake-up signal;

applying a third predetermined level of power voltage which is less than said predetermined level of power voltage to at least one of the cathode and the anode of each sub-miniature fluorescent light of the at least one sub-miniature fluorescent light for not more than a predetermined time.

* * * * *